US006397948B1

(12) United States Patent
Williams et al.

(10) Patent No.: US 6,397,948 B1
(45) Date of Patent: Jun. 4, 2002

(54) SHEARING ARRANGEMENT FOR SUBSEA UMBILICALS

(75) Inventors: Michael R. Williams, Houston, TX (US); John A. Johansen, Kongsberg (NO); Christina A. Ross, Houston, TX (US); David E. Wendt, Houston, TX (US); Sylvester A. Joan, Houston, TX (US); Stanley J. Rogala, Katy, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 09/433,413

(22) Filed: Nov. 3, 1999

Related U.S. Application Data

(60) Provisional application No. 60/106,861, filed on Nov. 3, 1998.

(51) Int. Cl.[7] ..... E21B 43/013

(52) U.S. Cl. ..... 166/363; 114/221 A; 83/701

(58) Field of Search ..... 166/338, 363, 166/364; 114/221 A; 83/701, 950, DIG. 1, 198, 694

(56) References Cited

U.S. PATENT DOCUMENTS

| | | | | | |
|---|---|---|---|---|---|
| 2,755,550 A | | 7/1956 | Benjamin | | |
| 3,621,744 A | * | 11/1971 | Kelly | | 83/701 |
| 3,633,667 A | | 1/1972 | Falkner | | |
| 3,882,748 A | * | 5/1975 | Moore | | 83/624 |
| 4,640,136 A | * | 2/1987 | Douglas | | 114/221 A |
| 4,653,776 A | | 3/1987 | Borg | | |
| 4,923,005 A | | 5/1990 | Laky et al. | | |
| 5,177,317 A | | 1/1993 | Walker et al. | | |
| 5,703,315 A | | 12/1997 | Coggan | | |

* cited by examiner

*Primary Examiner*—David Bagnell
*Assistant Examiner*—John Kreck
(74) *Attorney, Agent, or Firm*—Gary L. Bush, Esq.; Andrews & Kurth - Mayor, Day, Caldwell & Keeton

(57) ABSTRACT

A load limiting break away arrangement for a subsea umbilical includes telescoping inner and outer bodies. The inner body includes multiple cross-bored holes; the outer body has slotted openings on its top and bottom sides. A shearing blade is positioned at one end of a top slot of the outer body. Individual umbilical tubes pass through a bottom slot of the outer body, through individual holes in the inner body and out a top slot of the outer body for attachment to multiple quick connect couplers on an umbilical termination head of an Umbilical Termination Assembly (UTA) and of an Electro-Hydraulic Distribution Module (EHDM). Tension resistant actuation members run between the UTA and EHDM so that when a snag of an umbilical occurs, the inner and outer bodies are pulled apart and the tubes are severed one by one by the blade of the outer body.

13 Claims, 8 Drawing Sheets

SHEARING ARRANGEMENT FOR SUBSEA UMBILICALS

CROSS REFERENCE TO PRIOR APPLICATION

This application claims priority from Provisional Application 60/106,861 filed Nov. 3, 1998.

BACKGROUND OF THE INVENTION

1. Field of the Invention

This invention generally concerns the field of subsea production systems, but in particular is for an arrangement for breaking away subsea umbilicals in the event they are snagged. Still more particularly, this invention concerns an arrangement for shearing metallic or metal reinforced subsea umbilicals.

2. Description of the Prior Art

Offshore oil and gas fields are often developed using subsea production systems having the wells and related equipment installed directly on the seabed. A typical prior arrangement of a subsea production system 5 with a cluster of subsea wells 10 is illustrated in FIG. 1. In the system shown, a number of subsea wells are drilled in a cluster around a central subsea gathering manifold 12. Well jumper piping 11 couple the wells 10 to the subsea manifold 12. Subsea christmas trees installed on the wells control the flow of oil and/or gas from the wells. Production from each subsea tree is routed into the manifold 12 via jumper piping 11, and then it is transported back to shore via export pipelines 14 laid on the seabed.

Hydraulically actuated valves and chokes mounted on the subsea trees, and actuated valves mounted on the manifold 12, provide an arrangement to regulate and control the flow of produced fluids. Hydraulic fluids for operating the valves and chokes are delivered to the subsea production system via one or more main hydraulic supply umbilicals 16 laid on the seabed, as shown in FIG. 1. Distribution umbilicals 18 deliver fluids from the main umbilicals 16 to the individual subsea trees of wells 10 (and sometimes directly to the manifold 12 as well). Both the main umbilicals 16 and the distribution umbilicals 18 typically consist of several individual hoses or tubes enclosed within a protective sheathing. Umbilicals containing a dozen or more tubes are not uncommon. In addition to hydraulic fluids, the umbilicals may also deliver corrosion inhibitors, hydrate suppression chemicals, and/or other service fluids to the subsea system. In some cases, one or more tubes in the umbilical serve as vent lines for bleeding annulus pressure from the well casing and/or for depressurizing the manifold 12 and flowlines 14 (for hydrate control and/or remediation).

In the past, hydraulic umbilicals servicing subsea production systems have been constructed of thermoplastic hose. While thermoplastic hose was adequate for subsea applications in shallow to medium depth waters, it is not suitable for use in deep water where ambient hydrostatic pressure can be several thousand pounds per square inch. Some of the fluids contained within the umbilical tubes are significantly less dense than seawater, for example: methanol used for hydrate inhibition. In deep water the tubes containing low density fluids are subjected to a significant external pressure differential. Thermoplastic hose has limited resistance to collapse and is therefore unsuitable for such applications. Umbilical tubes used as "vent" lines may also be subjected to high external collapse pressure during venting operations when internal pressure falls well below seawater ambient pressure. (Such conditions are typical during hydrate control operations.) Thermoplastic hoses are clearly not suitable for such venting operations, due to the collapse problem mentioned above. For these reasons, metallic tubes or metal reinforced hoses are replacing thermoplastic hoses in umbilicals serving subsea production systems in deep and ultradeep waters.

Although the new metallic tube umbilicals provide excellent collapse resistance, they could pose a serious threat to a subsea system unless adequate snag load protection is incorporated into the system design. With thermoplastic hose umbilicals, snag loads are a lesser concern because such hoses have relatively low tensile strengths. If a subsea umbilical were to be snagged, the thermoplastic hoses typically break away without damaging the attached subsea equipment. This is not the case for umbilicals constructed of metallic tubes, or metal reinforced hoses, because each tube has a tensile strength in the range of 15 kip or more. Some subsea equipment, particularly subsea Christmas trees, could be severely damaged if subjected to umbilical snag loads in excess of 20–40 kips. Since umbilicals containing 10 or more tubes are not uncommon, the total combined snag load which could be transmitted by the umbilical to the subsea equipment is clearly a concern. As a result, an effective and reliable load limiting break away device within the umbilical system is essential.

One approach, used in some prior art metal tube umbilicals, is to provide a sequential break away device based on staggered lengths of tubing. In the event of a snag, the individual tube lengths are sized so that they fail in tension, hopefully one at a time, as the individual tubes are stretched to their breaking point The shortest length of tubing should fail first when it reaches its ultimate stress, followed by the next longest tube, etc. In theory, this design should limit the maximum snag load transmitted to the subsea equipment However, this type of break away device has several disadvantages. First, a rather large physical space is typically needed to house the necessary mounting bullheads and the substantial lengths of staggered tubing required for proper operation. In addition, the high ductility and elongation of the metal tubing usually results in several tubes being loaded before the first tube has parted. Thus, if a snag occurs, several tubes may be transmitting load to the subsea equipment during the progressive break away, increasing the total snag load acting on the subsea equipment.

Some prior art thermoplastic hose umbilicals have been equipped with Guillotine type cutter devices which are designed to shear the entire umbilical assembly in the event of a snag. One typical guillotine-type umbilical shearing device is commercially available from Oceaneering Company of Tomball, Texas. The Oceaneering guillotine style "weaklink" is normally installed on the unarmored umbilical jumper between the Umbilical Termination Assembly (UTA) and the Subsea Installation. The jumper is installed through the guillotine perpendicular to the jumper axis. Tensile loads are reacted through a chain assembly (shorter than the umbilical jumper) attached to the UTA and the subsea installation. Another guillotine weaklink device provides a large tapered guillotine blade to shear the multiple tubes spaced in a horizontal pattern through an opening facing the guillotine blade. Both devices use a cable or chain to actuate the guillotine cutter blade to sever the umbilical in the event of a snag. Intentional slack is provided in the umbilical to ensure that the cable or chain will become taut (and thereby actuate the guillotine blade to cut the umbilical) before excessive tensile loads are reacted into the attached subsea equipment. With the prior art Oceaneering, guillotine cuter device, the guillotine blade must shear several tubes within the umbilical simultaneously. This leads to a much higher break away load reaction into the attached subsea equipment than if the tubes were severed individually. The situation may also be similar for the second guillotine cutter device mentioned above if the tapered cutter blade causes individual tubes to "bunch up" due to side loading. Although these guillotine-type cutter devices work well on thermoplastic hose umbilicals (which are relatively easy to cut with reasonable loads), this type of break away device may not be applicable for use with metal tube or metal reinforced hose umbilicals due to excessive actuation load requirements.

IDENTIFICATION OF OBJECTS OF THE INVENTION

A primary object of this invention is to provide an effective and reliable load limiting break away device for a subsea umbilical.

Another object is to provide a compact, reliable reduced force break away device for a metal tube subsea umbilical system.

Another object of the invention is to provide a breakaway device which not only limits the maximum snag load transmitted into attached subsea equipment, but also allows pre-selection of the order in which individual tubes of the umbilical are severed, thereby ensuring a more controlled break away function; for example with hydraulic lines powering fail-closed valves on subsea trees and manifold being severed first for enabling such valves to close (thereby shutting in the subsea wells) prior to severing lines which are (or could be) exposed to well bore pressure.

Another object of the invention is to provide a break away device which also incorporates an integral safety device that resists premature actuation and/or tube damage during normal installation operations.

SUMMARY OF THE INVENTION

The object identified above as well as other features and advantages of the invention are incorporated in a break away device which includes inner and outer bodies for severing individual tubes of a subsea umbilical in the event of a snag of the umbilical. The outer body has a longitudinal cavity through it with upper and lower slots through body walls which are spaced 180° from each other. The outer body has a first connection arrangement at a first end. The upper slot has a blade secured adjacent to a second end of the outer body which faces inwardly in the slot toward the first end.

The inner body is positioned for telescopic movement within the cavity of the outer body with a first end of the inner body inserted into the cavity of the outer body with a second end extending outwardly from the second end of the outer body. The inner body has a second connection arrangement at the second end. The inner body is formed from a solid bar with a plurality of holes, one hole for each of the plurality of umbilical tubes. The holes have their axes aligned with upper and lower slots of the outer body.

A plurality of individual jumper tubes are connected between first end and second end umbilical termination devices. The jumper tubes extend through upper and lower slots of the outer body with only one tube provided for each hole of the inner body. A first tension resistant member, such as a cable is connected between the first connection arrangement of the outer body and the first umbilical termination device, and a second tension resistant member is connected between the second connection arrangement of the inner body and the second umbilical termination device. When large opposing forces act on the first and second umbilical termination devices, for example when a main subsea umbilical is snagged on the sea floor by an anchor of a vessel or the like, the inner body is pulled out of the cavity the outer body with the blade in the top slot severing jumper tubes and uncoupling the first and second umbilical termination devices.

The first and second termination devices may be umbilical termination heads of an "in-line" umbilical on the sea floor. Alternatively the termination devices may be an umbilical termination head connected to a main supply umbilical and an electro-hydraulic distribution module connected to subsea wells.

BRIEF DESCRIPTION OF THE DRAWINGS

The objects, advantages, and features of the invention will become more apparent by reference to the drawings which are appended hereto and wherein like numerals indicate like parts and wherein an illustrative embodiment of the invention is shown, of which.

DESCRIPTION OF THE PREFERRED EMBODIMENTS OF THE INVENTION

Figure 2:
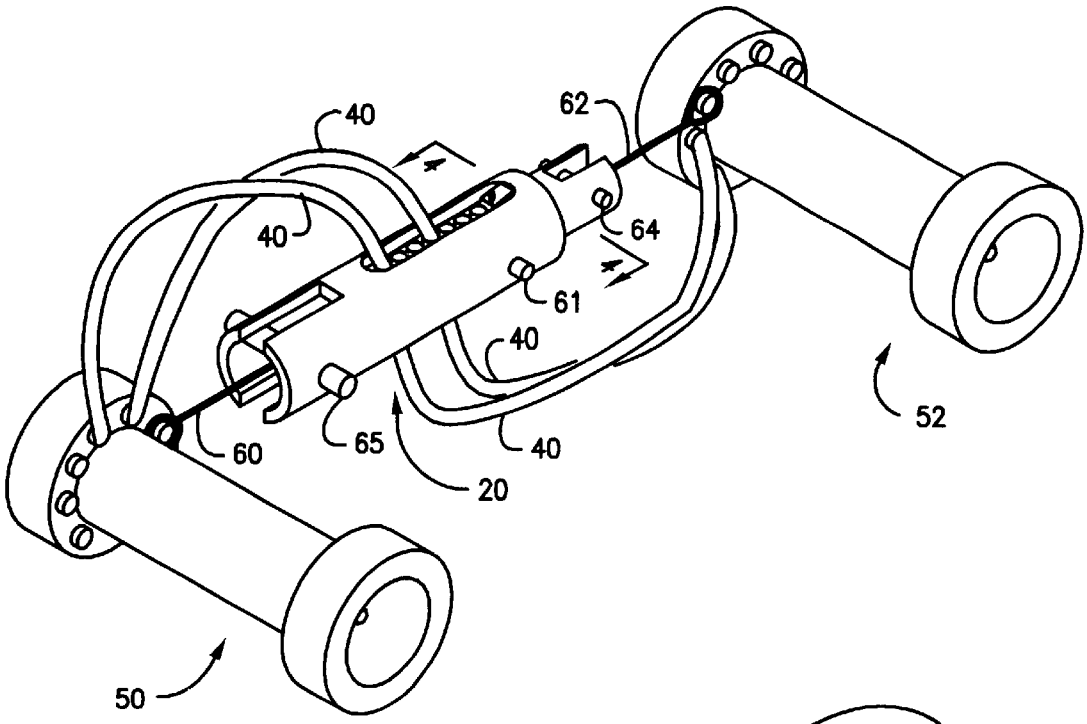
FIG. 2 illustrates a schematic of preferred embodiment of the break away device of this invention.
Figure 3:
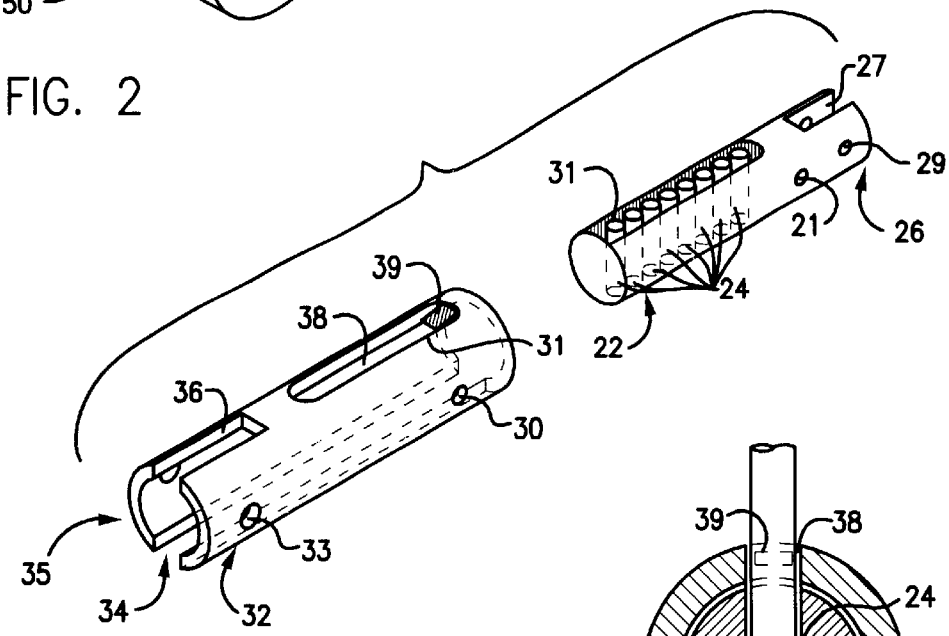
FIG. 3 is a perspective view of the components of the shearing mechanism of the break way device of FIG. 2.
Figure 4:
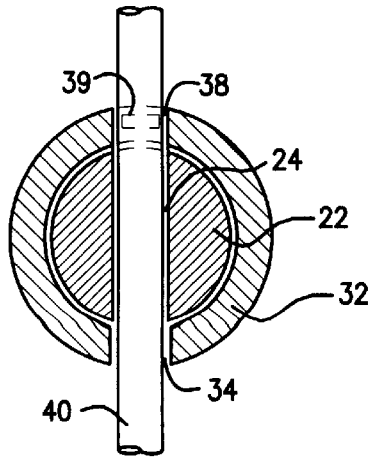
FIG. 4 is a cross-section taken along lines 4—4 of FIG. 2 showing a tube running through the shearing mechanism.

FIGS. 2, 3, and 4 illustrate the preferred embodiment of the umbilical break away device 20 of the invention. The main elements of the device are an inner body 22 with multiple cross drilled holes 24 and an outer body 32 with slots which define slotted openings at its top and bottom. A fill length slot 34 is positioned at the bottom of outer body 32. Partial longitudinal slots 36, 38 are placed on the top of outer body 32 at 180° from the bottom slot 34. Outer body 32 is formed from a hollow steel bar with thick walls, for example ¾" to 1" thick. Inner body 22 is formed from a solid round steel bar, for example 2½" to 3" diameter. A hollow rectangle outer body and a rectangular inner body may alternatively be used. The inner body 22 is placed in a telescoping relationship inside the hollow outer body 34 with holes 24 aligned with slots 34 and 38. Individual umbilical tubes 40 are passed via bottom slot 34, through the cross drilled holes 24 in the inner body 22, and through the slot 38 in the outer body 32. Each of the holes 24 have a diameter which is slightly larger than the outer diameter of a control line tubing 40 that passes through them. A downwardly facing shearing blade 39 is secured (as by welding) in the top slot 38 of outer body 32 so as to face control lines extending transversely thereto from holes 24 in inner body 22. Stellite weld overlay 31 is provided on shearing blade 39 and about the openings of holes 24 on the top surface of inner body 22.

Figure 1:
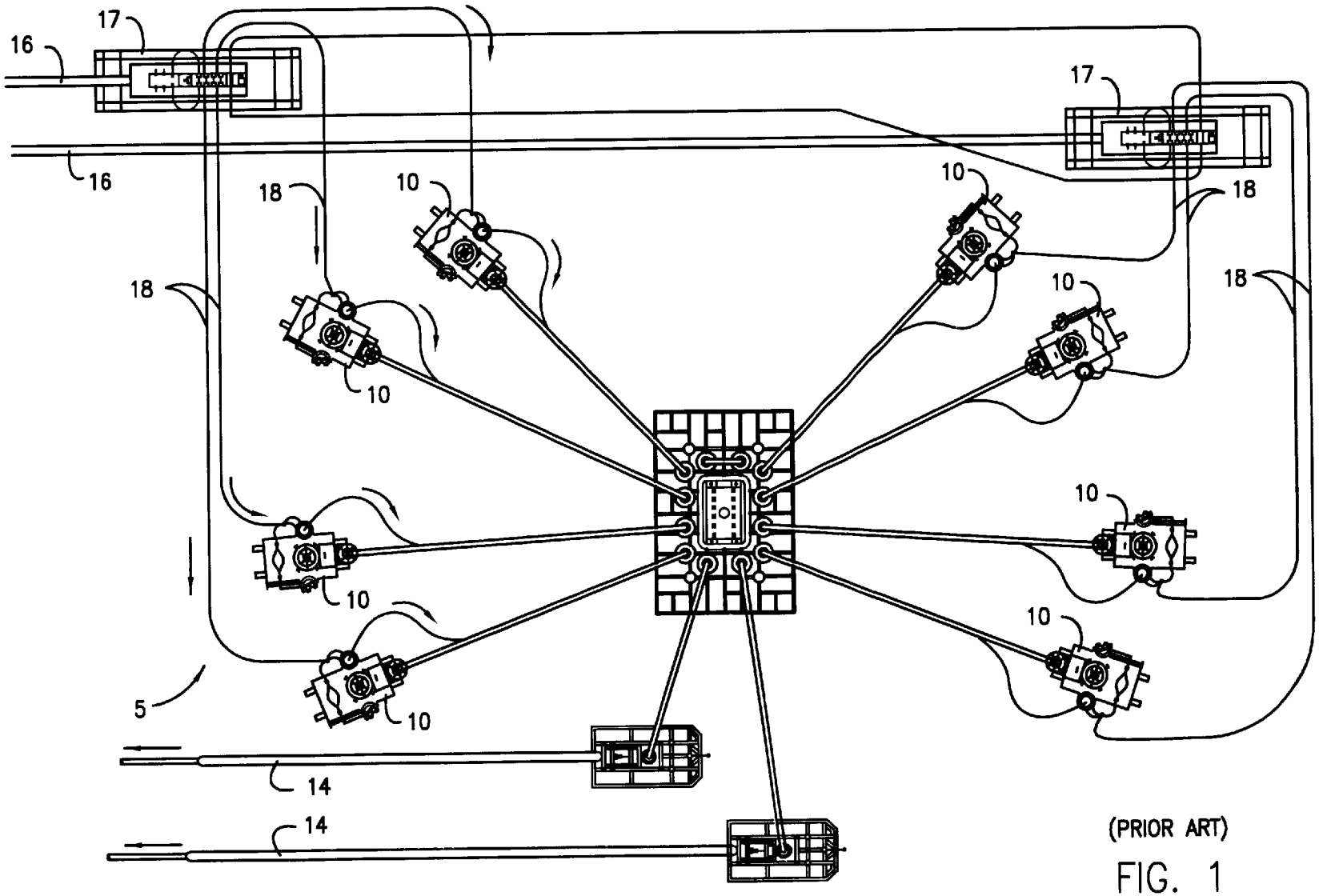
(PRIOR ART) FIG. 1
FIG. 1 is a prior art illustration of a typical subsea production system with cluster wells and manifold.

Attachment structures are provided at one end 26 of the inner body 22 and at an opposite end 35 of the outer body 32, for attachment of actuation cables which are appropriately anchored to adjacent subsea equipment as described below. At the end 26 of inner body 22, a short longitudinal slot 27 and transverse hole 29 are provided for attaching actuation cable 62 to a pin 64 through hole 29. At the opposite end 34 of outer body 32, a hole 33 is formed transversely to top and bottom slots 34, 36 so that a pin 65 may be placed therethrough for attachment of actuation cable 60. In the embodiment shown in FIG. 2, actuation cables 60, 62 are anchored to the multiple quick connect (MQC) couplers 50, 52 which connect opposite ends of umbilical jumper control lines 40 of the Umbilical Termination Assembly. One or more Umbilical Termination Assemblys (UTA) 17 are positioned in the subsea production arrangement as illustrated in FIG. 1.

If an umbilical snag were to occur, the outer body 32 of the break away device 20 slides, in a telescoping manner, relative to the inner body 22. As the telescoping action takes place, the cutting surface of shearing blade 39 at one end of the upper slot 38 in the outer body 32 sequentially shears individual umbilical tubes 40 passing through the cross drilled holes 24 in the inner body 22. Because a true shearing action is used, the force required to cut an individual tube 40 is reduced by 40–50 percent compared to that required to fail the tube in pure tension. The slot 34 in the bottom of the outer body 32 extends across the full length of the outer body 32 such that the tubing is cut in a "single shear" mode, rather than "double shear", thereby reducing the cutting force required.

Because the individual tubes 40 are positively restrained and sheared one at a time, it is not possible for multiple tubes to be loaded simultaneously during the break away event. Thus, the maximum snag load transmitted to the subsea equipment during a snag event is substantially reduced over prior art designs which employ a tensile type tube break away mechanism.

A close sliding fit is provided between the inner body 22 and outer body 32 to ensure a clean shearing action with minimal tendency to extrude tubing material into the gap. Also, the shape of the cutting blade 39 surface in the outer body slot 38 is preferably configured as an angular cutting edge, although a square shoulder may alternatively be provided. An angular cutting edge with particular arrangements may provide a more efficient cutting action and reduce the tendency for the outer body 32 to lift away from the inner body 22 as the tubing 40 is sheared as compared to an alternative square shoulder design. Hardfacing material such as stellite and/or a hard metal weld overlay may be provided to strengthen the cutting surface at the end of the upper slot, as well as on the top surface of the inner body, as shown in FIG. 3.

Figure 5A:
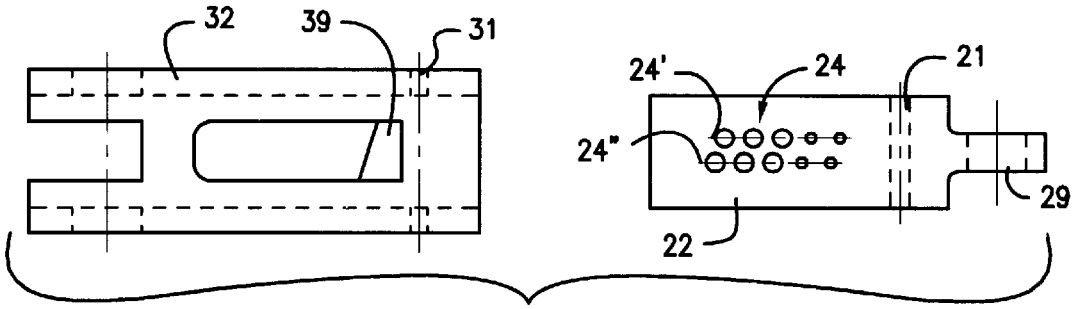
FIGS. 5A, 5B, and 5C are top, side and bottom views of outer and inner elements of a round body embodiment for a break away device of the invention with FIG. 5D showing a cross-section of the inner element of the device.
Figure 5B:
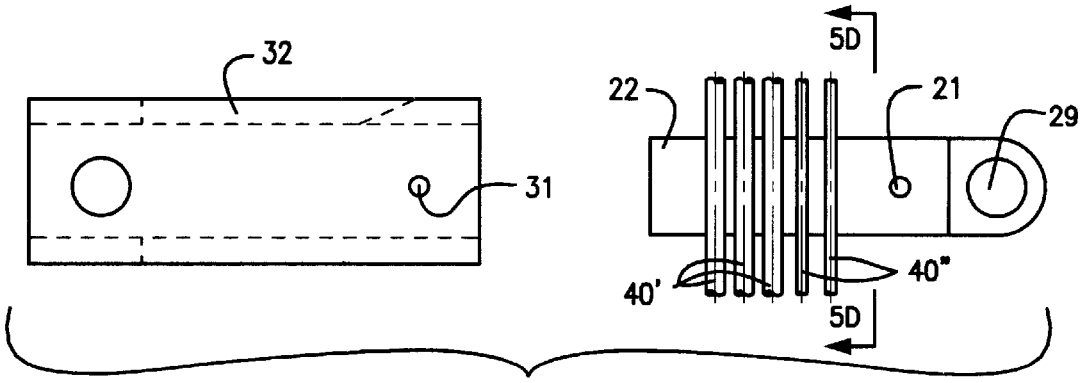
Figure 5C:
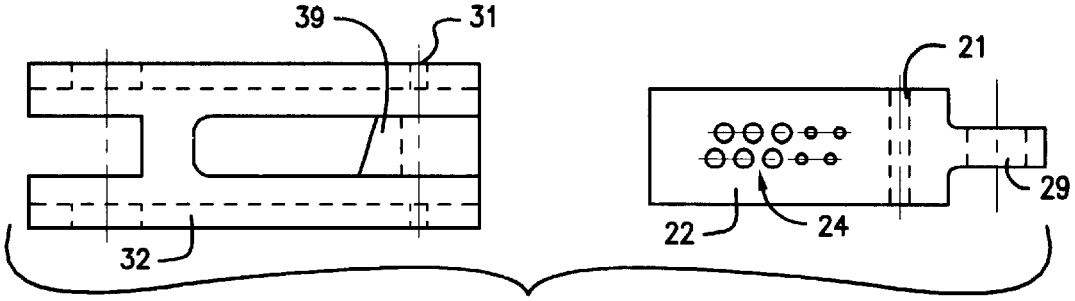
Figure 5D:
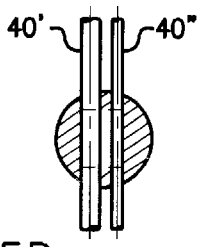

To prevent premature actuation of the break away device during normal operation, a small diameter shear pin 61 is installed through aligned holes 21, 30 between the inner and outer bodies 22, 32(see FIGS. 2 and 3). The shear pin 61 is typically sized to fail at a load approximately equal to, or slightly higher than, the shear value of the smallest tube 40 passing through the break away device 20. If an umbilical snag occurs, tension from the snagged umbilical first shears the pin 61, and then sequentially shears the umbilical tubes 40 in a controlled manner, typically one tube at a time. Alternatively, as shown in FIGS. 5A, 5B, and 5C, the pattern of the cross drilled holes 24 through the inner body 22 are staggered and placed in two rows of holes 24 (e.g., row 24' and row 24"), for a one at a time tube shearing action with alternating shearing of tubes in the rows as they approach blade 39. Notice that smaller and larger diameter holes are provided for larger diameter tubes 40' and smaller diameter tubes 40". Other patterns can also be used to provide a combination of shearing actions. For example, where both large and small tubing sizes are involved, an optimum break away unit design combines staggered holes for multiple shearing of the smaller diameter tubes and in-line holes for individual shearing of the large diameter tubes. The in-line hole pattern provides the smallest possible break away force, because tubes are sheared in line, one after another. In contrast, the staggered design allows all the tubes to be severed with a shorter total stroke length, which may be preferable under certain conditions.

The break away device 20 can be configured using round bodies, as shown in FIGS. 5A, 5B, 5C and 5D. Alternatively, the break away device 20 can be configured using square or rectangular bodies, as mentioned above. The square or rectangular body design is indicated when a staggered hole pattern and multiple tube shearing action is preferred. The simpler round body design is indicated where an easily manufactured and cost effective configuration is desired.

Figure 6:
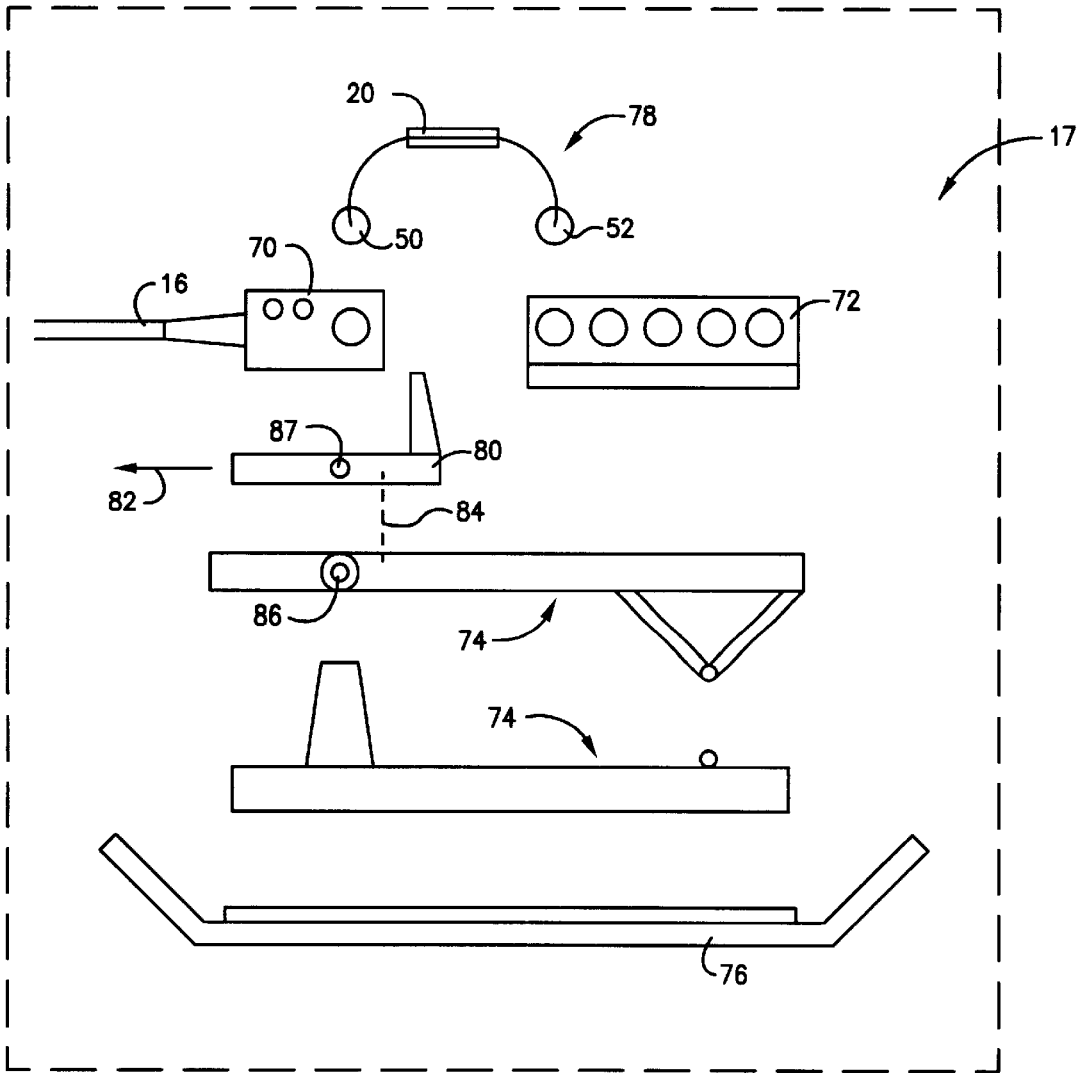
FIG. 6 is an exploded schematic illustration of a break away device incorporated into a subsea Umbilical Termination Assembly.
Figure 7A:
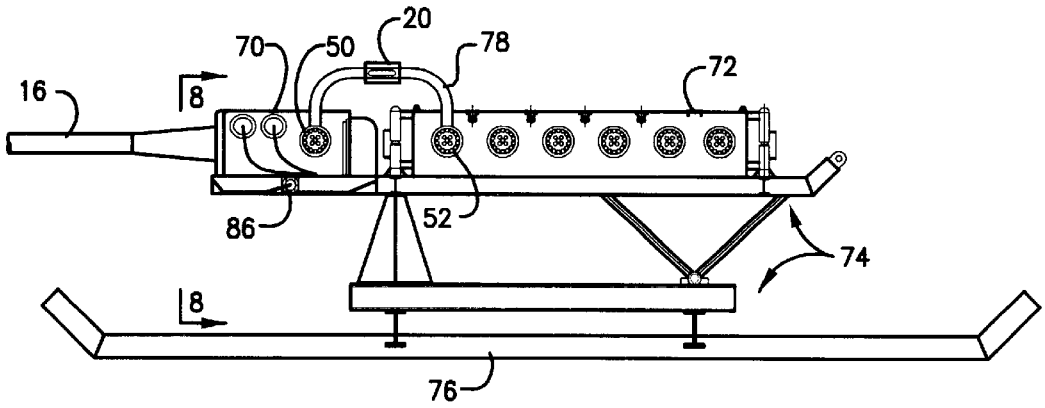
FIGS. 7A and 7B are more detailed side and top views of an Umbilical Termination Assembly including the break away device of the invention incorporated into a subsea Umbilical Termination Assembly.
Figure 7B:
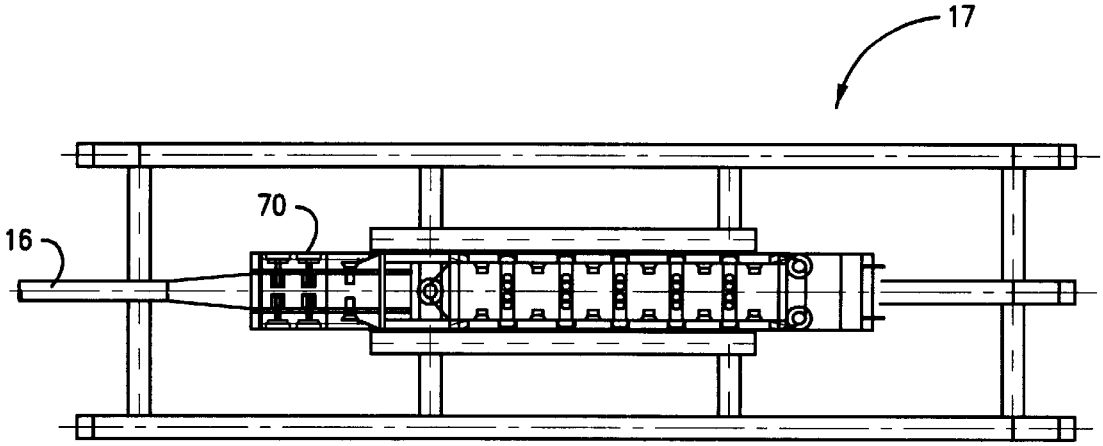

FIGS. 6, 7A and 7B show the preferred embodiment of the Umbilical Termination Assembly Jumper (UTAJ) break away device 20 of the invention incorporated into an Umbilical Termination Assembly (UTA) 17 which connects the man Umbilical Termination Head (UTH) 70 to the Electro-Hydraulic Distribution Module (EHDM) 72. See FIG. 1 for placement of the UTA 17 in a subsea system. The UTH 70 and the EHDM 72 are mounted on top of the UTA support frame 74, which is mounted to a mud mat assembly 76 to prevent the unit from sinking into the seabed. FIG. 6 shows these components in exploded and schematic form while FIG. 7 illustrates the actual hardware configurations in side and top views. The UTAJ jumper 78 includes a bundle of individual tubes which deliver fluids from the main umbilical 16 to the EHDM 72. One end of the UTAJ jumper 78 is attached to the UTH 70 by means of a multiple quick connector (MQC) 50. The opposite end of the jumper 78 is attached to the EHDM 72, also using an MQC, referenced here as 52. The MQC assemblies 50, 52 contain hydraulic couplers for up to 13 umbilical tubes, and incorporate attachment devices for connecting the actuation cables 60, 62 (See FIG. 2) for the progressive tube shearing break away device 20.

The main umbilical 16 and its end termination (UTH) 70 are mounted on a sliding carriage 80 (the UTH mount frame). The entire apparatus is designed and arranged to slide off of the UTA support frame assembly 74 in the event of a snag of umbilical 16. Reference number 82 points to an arrow in the direction of travel when UTH assembly 70 is snagged. The arrangement is best illustrated in FIGS. 7A and 7B. The UTA 17 is securely mounted onto the UTH mount frame 80, which rides in rails on the UTA. support frame 74. If the umbilical were to be snagged, the umbilical 16, the UTH 70, and the UTH mount frame 80 slide in the direction of arrow 82. A small retention device, typically a shear pin or frangible bolt, secures the UTH mount frame 80 to the UTA support frame 74 and prevents premature movement of the umbilical during normal operations. The shear pin or frangible bolt (indicated schematically by line 84 in FIG. 6) is typically sized to break at a load equal to, or slightly higher than, the shear value of the smallest tube passing through the break away device.

Figure 8:
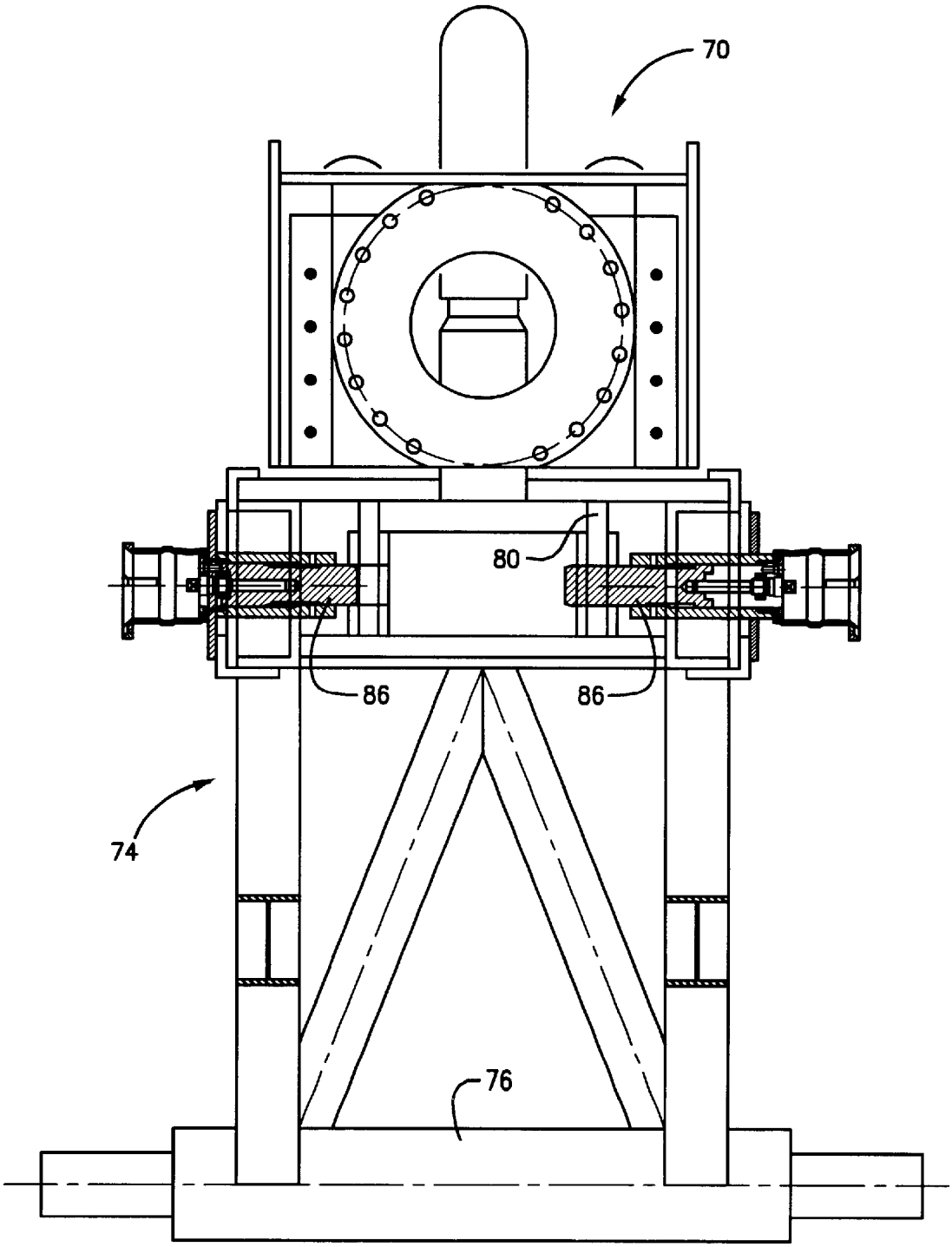
FIG. 8 is an end view of the Umbilical Termination Head of FIG. 7A with ROV releasable latch pins.
Figure 9A:
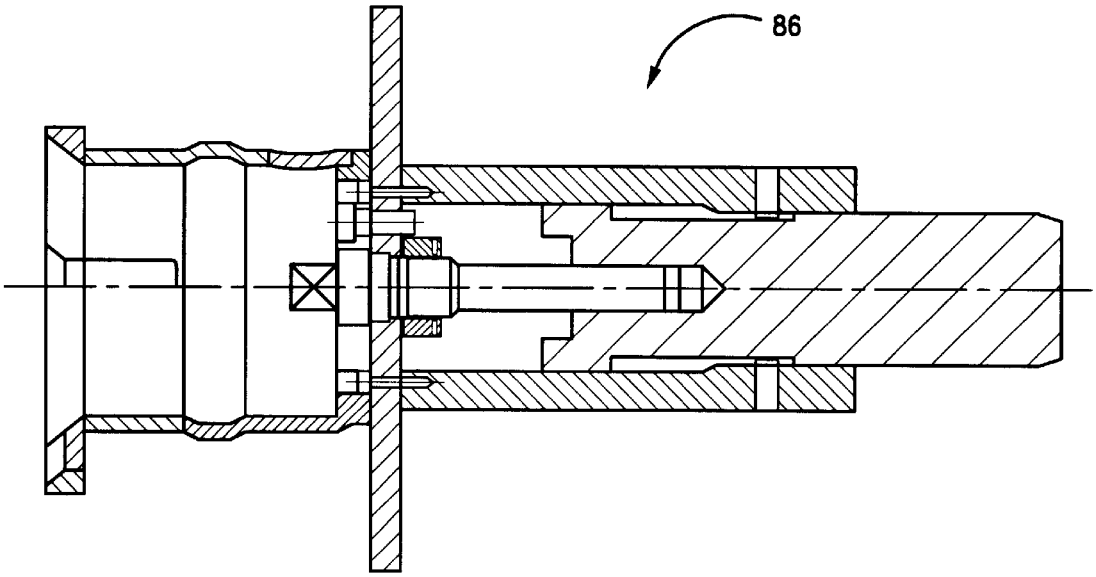
FIGS. 9A and 9B present more detailed drawings of the ROV releasable latch pins of FIG. 8 with FIG. 9A showing the latch pin in a latched position and with FIG. 9B showing the latch pin in an unlatached position.

As shown in FIGS. 6, 7A, and 8, one or more ROV releasable latch pins 86 are used to structurally connect the sliding components 80 to the stationary components 74 of the Umbilical Termination Assembly 17. The releasable latch pins 86 prevent premature actuation of the break away device 20 during installation (and provides for possible recovery) of the umbilical 16 and its termination hardware. The latch 86 is a large structural retaining pin which is designed and arranged for actuation by an ROV (remotely operated vehicle) using the same torque tool which operates the MQC end connector 50 on the umbilical jumper assembly. FIGS. 8 and 9 illustrate the design of the ROV releasable latch pins 86 and their location within the UTA assembly. The latch assemblies are located on the UTA support frame 74, positioned such that they align with the mating hole 87 in the UTH mount frame 80 (see FIG. 6). Prior to installation of the umbilical 16 and the UTA 17, the latch pins 86 are rotated into their extended position, as shown in FIG. 9A, such that the large diameter "nose" of the pins engage the holes 87 in the UTH mount frame 80. The pins are designed and arranged to withstand the very large umbilical tensile loads (several tons) which are experienced during umbilical. installation and recovery. These pins 86 rigidly secure the main umbilical 16 and UTH 70 to the UTA foundation structure 74 during installation to ensure that the break away device 20 is not accidentally actuated.

Figure 9B:
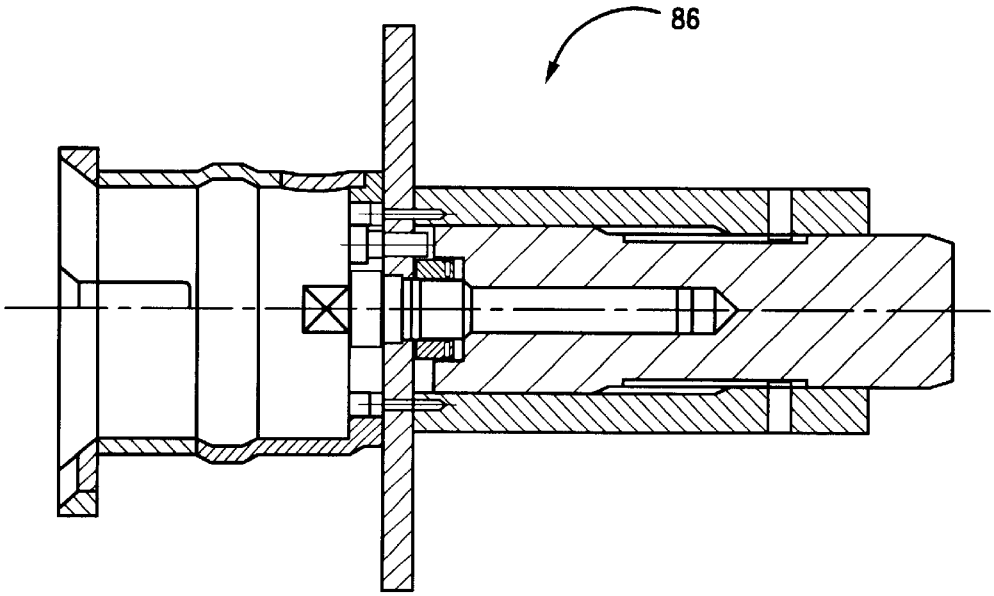

Once the umbilical 16 and termination assembly 17 is in place on the seabed, an ROV retracts the large latch pin 86 (as illustrated in FIG. 9B) prior to first operation of the subsea production system. With the latch pin 86 retracted, the break away device 20 is enabled to protect the subsea system from an umbilical snag.

When the umbilical 16 is snagged, the UTH 70 and its mount frame 80 slide off of the UTA support frame74 once the load exceeds that required to break the small retention bolt 84. Thereafter, further movement of the umbilical 16 and UTH 70 cause the UTAJ jumper assembly 78 to elongate. As this occurs, the actuation cables 60, 62 (see FIG. 2), attached to the inner 22 and outer 32 bodies of the break away device 20 become taut. When the load in the actuation cables reaches a sufficient level the shear pin 61 within the break away device is severed. Thereafter, the individual tubes 40, etc., in the UTAJ jumper assembly 78 are sheared in a predictable and controlled manner, thereby protecting the subsea equipment from damage and allowing the subsea valves to close in the wells.

Depending upon the application, there may be instances where two umbilical jumpers are required for connecting the UTH 70 to the EHDM 72. When two jumpers are required, two break away devices 20 may be configured to actuate simultaneously (when small tubing sizes and shear forces allow). Alternatively, the break away devices 20 can be arranged and designed to be actuated sequentially (using staggered lengths of actuation cables) to minimize break away loads when large tubing sizes and shear forces must be accommodated.

By positioning the break away device 20 within the umbilical jumper assembly 78, damage to the main umbilical 16 and the associated subsea equipment is minimized during a snag event. All components of the UTA umbilical termination assembly can be recovered following the snag event, and inspected and repaired as required, allowing the break away device 20 of the invention to be reinstalled along with a new or repaired umbilical 16.

The order of tube failure during a snag event is important. It is desirable for the tubes supplying hydraulic control fluids to the subsea equipment to fail first. In this manner, the fail-safe valves on the subsea trees and/or manifold move to their "safe" position immediately upon loss of hydraulic pressure from the severed umbilical tube(s). Certain other umbilical tubes, such as chemical injection lines and/or vent lines, should be severed last to minimize the potential for backflow of well fluids into the environment This approach also helps minimize seawater ingress into the wells or manifold system. Accordingly, tubes 40 supplying hydraulic control fluids should be positioned nearest blade 39 while chemical injection lines and/or vent lines should be positioned farthest from blade 39. The progressive tube shearing type break away device 20 of this invention allows the user to predetermine the exact order of tube failure during a snag event by placing specific tubes into the appropriate cross drilled holes in the inner body.

Figure 10:
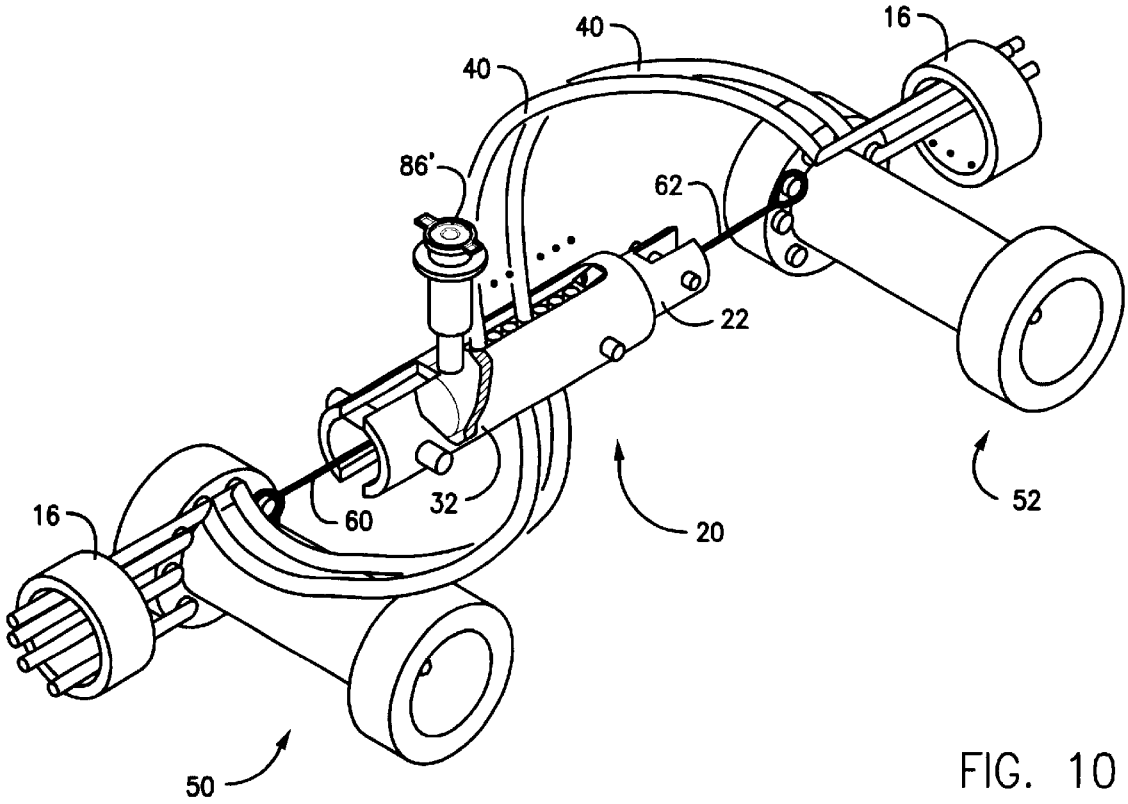
FIG. 10 illustrates a mid-umbilical line installation of the break away device of the invention.

The break away device 20 of the invention may be incorporated into the umbilical termination assembly (UTA) as described above, or, it may be installed directly into the umbilical itself, as a mid-line installation as illustrated in FIG. 10. In the mid-line embodiment, a large ROV removable latch pin 86' is used to secure the inner 22 and outer 32 bodies of the by away device 20 against premature actuation during installation of the umbilical. The pin 86' (constructed as illustrated in FIGS. 9A, 9B) is retracted by an ROV to "arm" or enable the break away device prior to placing the subsea system into operation. As in the jumper mounted device, a small diameter shear pin between the inner and outer bodies prevents premature actuation of the mid-line break away device and/or accidental tube damage during normal operations.

The progressive tube shearing type break away device 20 of the invention can also be used to provide snag load protection for any large diameter or armored subsea electrical cables serving the subsea production system. In some cases, the electrical cables and their associated armor have significant tensile strength and therefore create a potential snag load hazard for the subsea equipment to which they are attached. These electrical cables are sometimes integrated into the main umbilical, along with the hydraulic and chemical injection tubes, or they may be laid as a completely separate electrical umbilical. In either event, the progressive shearing type break away device of the invention may be easily adapted for use on the electrical cables to provide reliable snag load protection for the attached subsea equipment.

While preferred embodiments of the present invention have been illustrated in detail it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A load limiting break away arrangement for a subsea umbilical which includes a plurality of individual tubes comprising an outer body having a longitudinal cavity therethrough, said outer body having upper and lower slots through body walls to said cavity which are spaced 180° from each other, said outer body having a first connection arrangement at a first end, said upper slot of said outer body having a blade secured adjacent to a second end of said outer body which faces inwardly in said slot towards said first end;

an inner body positioned for telescopic movement within said cavity of said outer body, said inner body having a first end inserted into said cavity of said outer body with a second end extending outwardly from said second end of outer body, said inner body having a second connection arrangement at said second end, said inner body formed of a solid bar with a plurality of holes, one hole for each of said plurality of individual tubes, said holes having their axes aligned with upper and lower slots of said outer body, a plurality of individual jumper tubes connected between first end and second umbilical termination devices, and extending through said upper and lower slots of said outer body through one of said holes of said inner body, and a first tension resistant member connected between first connection arrangement of said outer body and said first umbilical termination device, and a second tension resistant member connected between said second connection arrangement of said inner body and said second umbilical termination device, whereby large opposing forces on said first and second umbilical termination devices cause said inner body to be pulled out of said cavity of said outer body with said blade severing jumper tubes and uncoupling said first and second umbilical termination devices.

2. The arrangement of claim 1 wherein, said first and second termination devices are umbilical termination heads of an umbilical on the sea floor.

3. The arrangement of claim 1 wherein, said first termination device is an umbilical termination head connected to a main supply umbilical, said second termination device is an electro-hydraulic distribution module connected to subsea wells and whereby, said umbilical termination head is arranged and designed to move apart from said electro-hydraulic distribution module when a snag force is applied to said main supply umbilical.

4. The arrangement of claim 1 wherein, said plurality of holes are positioned along a single longitudinal line of said inner body.

5. The arrangement of claim 1 wherein, said plurality of holes are positioned along two parallel longitudinal lines of said inner body.

6. The arrangement of claim 5 wherein, said holes of said two parallel longitudinal lines are staggered from each other as a function of longitudinal length along the two lines, whereby as said inner body is pulled from said inner body, a tube of one line is first severed, then a tube of the other line is next severed, and so on until all tubes have been severed and the inner body separates from the outer body.

7. The arrangement of claim 1 wherein, said inner and outer bodies are circular in cross section.

8. The arrangement of claim 1 wherein, said inner and outer bodies are rectangular in cross section.

9. The arrangement of claim 1 wherein, said blade has a cutting face which is angled with respect to a transverse axis of said outer body.

10. The arrangement of claim 1 wherein, a hard surface material overlays said blade and a top surface of said inner body around openings of said tubes.

11. The arrangement of claim 1 further comprising, a shear pin placed in aligned holes of said inner and outer bodies when said inner body is placed in said outer body, whereby said shear pin is arranged and designed to break where predetermined forces act on said first end of said outer body and on said second end of said inner body.

12. The arrangement of claim 3 wherein, said umbilical termination head and said electro-hydraulic distribution module are mounted on a support frame, and said umbilical termination head is releasably secured to said frame by an ROV actuated pin.

13. The arrangement of claim 12 further comprising, a small retention fastener placed between said umbilical termination head and said support frame, whereby said fastener is arranged and designed to break when a predetermined force on said umbilical acts to move said umbilical termination head from said support frame.

* * * * *

UNITED STATES PATENT AND TRADEMARK OFFICE

CERTIFICATE OF CORRECTION

PATENT NO. : 6,397,948 B1
DATED : June 4, 2002
INVENTOR(S) : Michael R. Williams et al.

It is certified that error appears in the above-identified patent and that said Letters Patent is hereby corrected as shown below:

Column 4,
Line 60, delete "fill", insert -- full --

Column 6,
Line 39, deleted "man", insert -- main --

Column 7,
Line 31, delete "."
Line 50, after "level", insert -- , --

Column 8,
Line 32, delete "by", insert -- break --

Signed and Sealed this

Fourteenth Day of January, 2003

JAMES E. ROGAN
*Director of the United States Patent and Trademark Office*